US005554037A

United States Patent [19]

Uleski

[11] Patent Number: 5,554,037

[45] Date of Patent: Sep. 10, 1996

[54] TERMINAL SUPPORT FOR USE WITH AN ELECTRONIC COMPONENT

[75] Inventor: Michael A. Uleski, Roseville, Mich.

[73] Assignee: United Technologies Automotive, Inc., Dearborn, Mich.

[21] Appl. No.: 204,471

[22] Filed: Mar. 1, 1994

[51] Int. Cl.[6] ..... H01R 9/09

[52] U.S. Cl. ..... 439/76.1; 439/741

[58] Field of Search ..... 439/76, 83, 736, 439/937, 357, 358, 741, 744

[56] References Cited

U.S. PATENT DOCUMENTS

| | | | |
|---|---|---|---|
| 3,551,874 | 12/1970 | Volinskie . | |
| 4,218,724 | 8/1980 | Kaufman . | |
| 4,385,791 | 5/1983 | Lovrenich . | |
| 4,732,565 | 3/1988 | Ito et al. | 439/83 X |
| 4,775,333 | 10/1988 | Grinder et al. | 439/937 X |
| 4,811,168 | 3/1989 | Chestnut et al. . | |
| 4,857,002 | 8/1989 | Jensen et al. . | |
| 4,909,745 | 3/1990 | Hayashi | 439/76 OR |
| 4,927,372 | 5/1990 | Collier | 439/83 OR |
| 4,952,529 | 8/1990 | Grider | 439/83 X |
| 5,244,410 | 9/1993 | Demus et al. | 439/736 X |
| 5,256,087 | 10/1993 | Hendel | 439/741 OR |
| 5,285,106 | 2/1994 | Deie | 439/797 X |
| 5,286,920 | 2/1994 | Fassel et al. | 439/76 X |
| 5,314,358 | 5/1994 | Klemmer et al. | 439/741 OR |

*Primary Examiner*—Larry I. Schwartz
*Assistant Examiner*—Daniel Wittels
*Attorney, Agent, or Firm*—Harness, Dickey & Pierce, P.L.C.

[57] ABSTRACT

A support structure for resisting deformation of an electronic component includes a terminal affixed to the electronic component and a carrier member affixed to the terminal which has a pressing member defining a pressing surface. A base has a stop member defining a stop surface which is adapted to engage the pressing surface and to resist a longitudinal force imposed on the terminal, thereby resisting deformation by that force of the electronic component.

25 Claims, 2 Drawing Sheets

TERMINAL SUPPORT FOR USE WITH AN ELECTRONIC COMPONENT

BACKGROUND OF THE INVENTION

1. Technical Field

The invention relates generally to terminals affixed to electronic components, and more particularly to a support structure for resisting physical deformation of an electronic component.

2. Discussion

Many electronic components, such as printed circuit boards and computer chips, have one or more terminals extending therefrom which are adapted to make electrically conducting contact with a connector to connect that electronic component, such as a circuit board, with various other electronic components. The terminals are generally rigidly affixed to the first electronic component. As a result, when an external force acts upon the terminals, it is also transferred to the electronic component, thereby stressing, deforming, and possibly damaging it.

For example, circuit boards are often provided with terminals which extend in a longitudinal direction which is perpendicular to a plane defined by the circuit board. The circuit board is generally peripherally supported within a housing. Any force imposed upon the terminals will therefore be transferred to a portion of the circuit board, thus imparting stress and a moment upon the circuit board. These forces will tend to deform the planar surface of the circuit board. Such deformation may damage the board itself, or may damage delicate electronic components affixed to a surface of the board, or may damage circuits imprinted upon the board.

By their nature, the terminals are adapted to be connected by a connector to other electronic components. Connectors are generally constructed having contact members and are adapted to be longitudinally slid into place onto the terminals. The contact members are adapted to laterally squeeze both sides of the terminal to provide satisfactory electronic connection. Unfortunately, when the connector is pushed longitudinally into position, the contact members impose a longitudinal connection force on the terminals by friction. This connection force may often be as large as 13 Newtons, and is transferred by the terminals to the circuit board, possibly damaging the board. In addition, the connectors are generally connected to the terminals manually, which often results in a variety of lateral forces being imposed upon the ends of the terminals. Many connectors are also adapted to be removed from the terminals, causing a second disconnection force by virtue of friction between the contact members and the terminals. All of these forces act upon the circuit board.

It is therefore desirable to provide a structure for supporting the terminals to resist forces imposed on the terminals, and to thereby protect the circuit boards or other electronic components from damage.

SUMMARY OF THE INVENTION

Accordingly, the present invention provides a novel support structure for physically supporting a terminal affixed to an electronic component to resist forces imposed upon the terminal, to resist deformation of the electronic component.

These and other various advantages and features of the present invention will become apparent from the following description and claims, in conjunction with the appended drawings:

DETAILED DESCRIPTION OF THE PREFERRED EMBODIMENTS

The following description of the preferred embodiments is merely exemplary in nature, and is in no way intended to limit the invention, or its application or uses.

Figure 1:
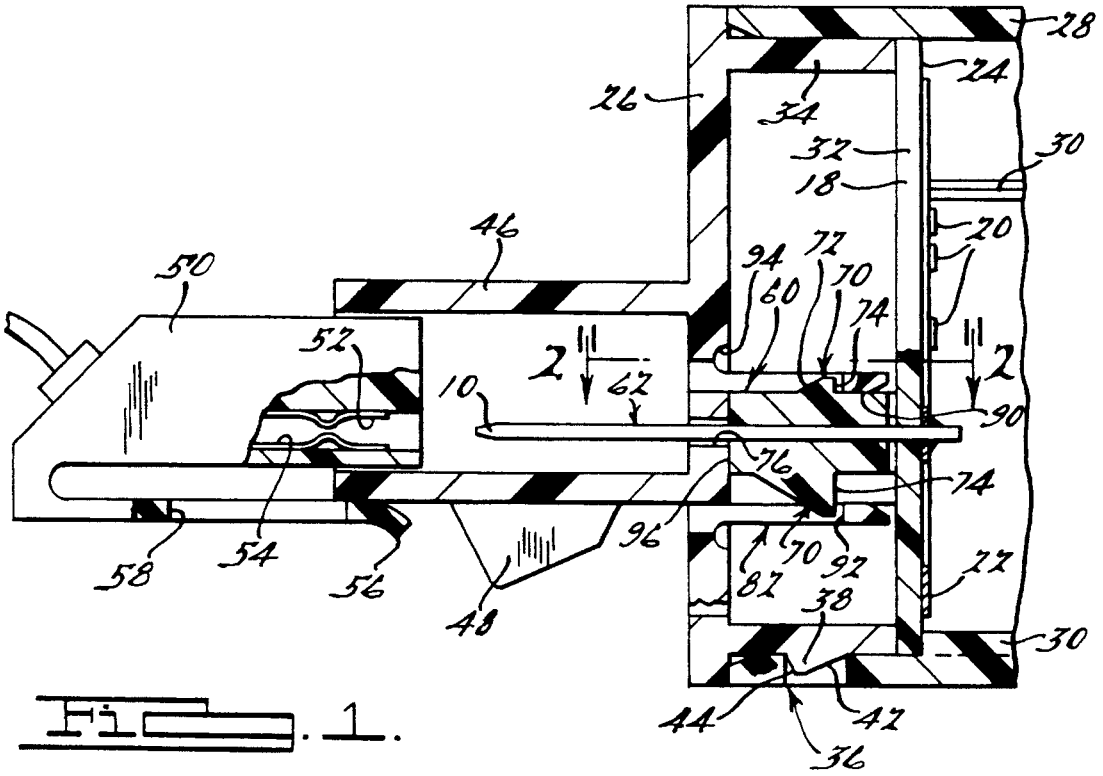
FIG. 1 is a partial cross-sectional view of a support structure according to the principles of the present invention, as well as a connector.
Figure 2:
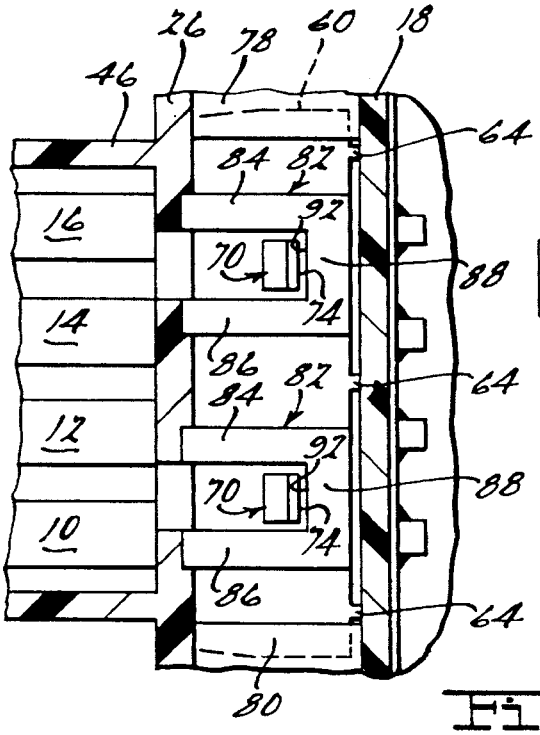
FIG. 2 is a partial cross-sectional view of the support structure of the present invention, taken generally along line 2—2 in FIG. 1.
Figure 3:
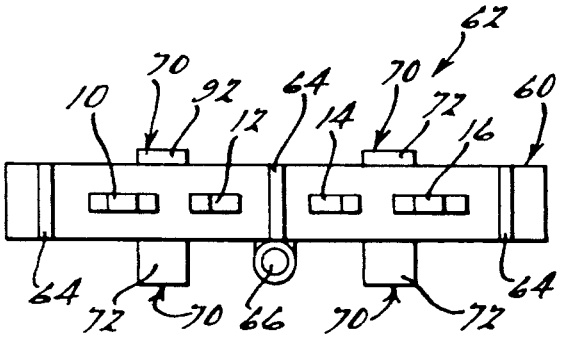
FIG. 3 is a bottom plan view of a carrier member assembled with a series of terminals according to the present invention.

With reference to the drawings, FIGS. 1 through 3 show a series of four terminals 10, 12, 14 and 16 which are affixed to a circuit board 18 having a variety of electronic components 20 affixed thereto, and having various circuits 22 printed on an inner surface 24 thereof. Circuit board 18 is held in a stationary position between a base 26 and a housing 28. Inner surface 24 of circuit board 18 is supported peripherally by a plurality of internal ridges 30 formed on housing 28. An opposite, outer surface 32 of circuit board 18 is peripherally supported by an annular collar 34 formed on base 26. Base 26 and housing 28 are adapted to be mutually affixed by a plurality of inter-fitting peripheral snap retainers 36. Retainers 36 are formed of a ramped projection 38 extending from collar 34 which fits within and engages an aperture 40 formed in housing 28. Ramped projection 38 has an inner cam surface 42 for causing a portion of housing 28 to deform to allow base 26 and housing 28 to be assembled, and an outer cam surface 44 for allowing base 26 and housing 28 to be disassembled.

Four terminals 10, 12, 14 and 16 are provided for electrically coupling electronic components 20 with an external electronic component (not shown). A shield 46 extends outward from base 26 for surrounding and protecting terminals 10, 12, 14 and 16. Shield 46 also has a fin 48 which projects outward for engaging a portion of a connector 50 which is provided for coupling terminals 10, 12, 14 and 16 to the external electronic component (not shown). Connector 50 has four pairs of first and second contact members 52 and 54 for contacting and laterally squeezing each terminal 10, 12, 14 and 16 to provide satisfactory electrical connection between terminals 10, 12, 14 and 16 and contact members 52 and 54. Connector 50 is adapted to slide longitudinally onto terminals 10, 12, 14 and 16 and has a flange 56 which forms a longitudinal channel for receiving a portion of shield 46. Flange 56 is adapted to be elastically deformed by fin 48 on shield 46 to allow connector 50 to be inserted into place. Fin 48 thereafter lockingly engages an opening 58 on flange 56 for resisting removal of connector 50 from base 26. Connector 50 thus imposes a longitudinal force onto both base 26 and terminals 10, 12, 14 and 16 when it is both connected and disconnected.

The novel support structure of the present invention includes an injection molded carrier member 60 which is rigidly affixed to terminals 10, 12, 14 and 16 for rigidly holding terminals 10, 12, 14 and 16 in a stationary parallel position relative to each other. The resulting carrier member and terminal subassembly 62 is affixed to circuit board 18 by individually soldering an inner or distal end of each terminal 10, 12, 14 and 16 to inner surface 24 of circuit board 18. Carrier member 60 is disposed adjacent to outer surface 32 of circuit board 18. A plurality of feet 64 are provided on carrier member 60 for contacting outer surface 32 of circuit board 18 to align carrier member 60, and thus terminals 10, 12, 14 and 16, perpendicular with circuit board 18 before the inner ends of terminals 10, 12, 14 and 16 are soldered in place. Carrier member 60 incorporates an alignment pin 66 for extending through an alignment hole 68 formed in circuit board 18, so that carrier and terminal subassembly 62 can only be assembled with circuit board 18 in the correct orientation. As a result, carrier member 60 enables terminals 10, 12, 14 and 16 to be easily assembled and affixed in place to circuit board 18 in a correct orientation. Carrier member 60 also has a pair of first and second opposing ramped projections 70 extending laterally from opposing sides of carrier member 60. Ramped projections 70 each have a cam surface 72 and a pressing surface 74 which are preferably inclined and perpendicular to longitudinal terminals 10, 12, 14 and 16 respectively. Pressing surfaces 74 are thus parallel to outer surface 32 of circuit board 18 when subassembly 62 is affixed thereto. As shown in FIG. 1, ramped projections 70 may be of differing sizes, to accommodate positioning requirements.

Base 26 and housing 28 are assembled by sliding outer ends of terminals 10, 12, 14 and 16 through four openings 76 formed in base 26 and then pushing base 26 and housing 28 together until peripheral snap retainers 36 are engaged. When base 26 is assembled and affixed to housing 28, terminals 10, 12, 14 and 16 each extend through openings 76 formed in base 26. Openings 76 thus resist lateral forces imposed upon terminals 10, 12, 14 and 16. In addition, terminals 10, 12, 14 and 16 are further supported against lateral forces and are prevented from moving laterally by a first and second pair of channel walls 78 and 80, which extend inwardly from the periphery of base 26, to form a channel for snugly receiving opposite lateral ends of carrier member 60. The novel support structure of the present invention further incorporates a first and second pair of tabs 82, each having a first and second leg 84 and 86 and a locking member 88 defining a follower surface 90 and a stop surface 92. Tabs 82 are lockingly engaged with pressing surfaces 74 when base 26 and housing 28 are assembled. As base 26 is pushed towards housing 28, follower portions 90 of locking members 88 engage and follow cam surfaces 72, causing legs 84 and 86 of tabs 82 to elastically bend outward to allow base 26 to be pushed onto housing 28. Locking members 88 thereafter elastically snap back into position and legs 84 and 86 straighten, so that stop surfaces 92 are positioned to engage pressing surfaces 74.

The support structure of the present invention thus provides stop surfaces 92 which are adapted to engage pressing surfaces 74 to resist a longitudinal inward connection force imposed on terminals 10, 12, 14 and 16, thereby resisting deformation by that force of circuit board 18. Moreover, base 26 provides a second stop surface 94 adapted to engage a second pressing surface 96 on carrier member 60 for resisting a longitudinal outward disconnection force imposed on terminals 10, 12, 14 and 16, thereby also resisting deformation of circuit board 18 by the disconnection force. Openings 76 and channel walls 78 and 80 formed on base 26 also are provided to resist lateral forces imposed on terminals 10, 12, 14 and 16, and to resist deformation of circuit board 18 by said lateral forces. Shield 46 formed on base 26 is also adapted for allowing connector 50 to be connected to terminals 10, 12, 14 and 16 only with longitudinal motion, to further prevent lateral forces from acting on terminals 10, 12 14 and 16 and circuit board 18.

Figure 5:
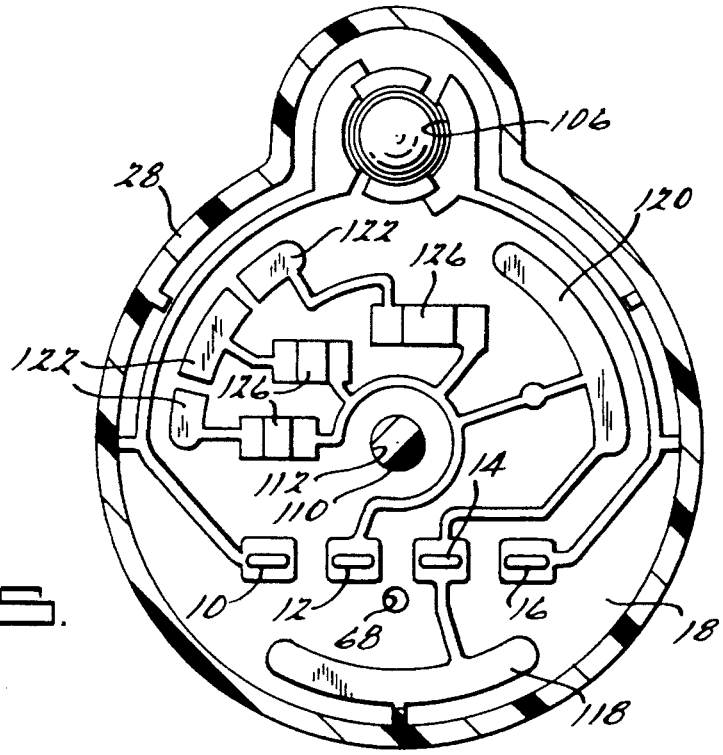
FIG. 5 is a cross-sectional view of the switch shown in FIG. 4.
Figure 4:
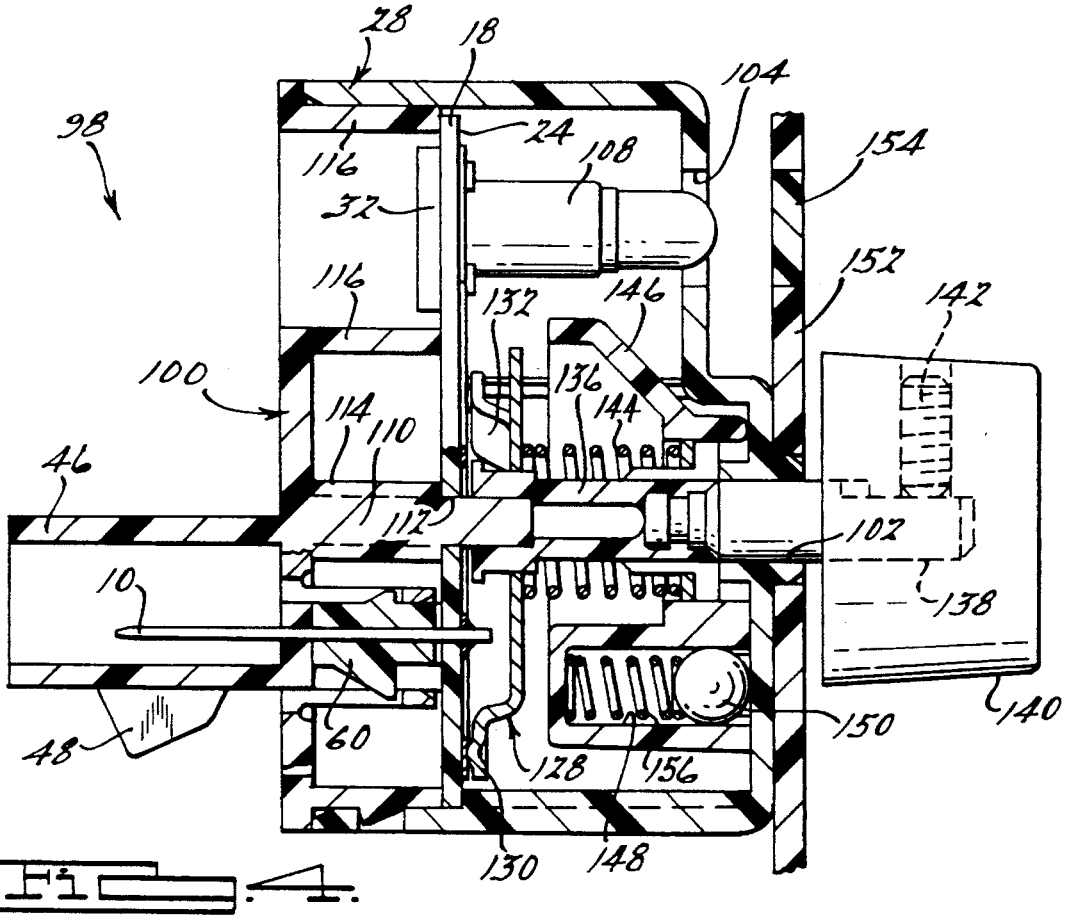
FIG. 4 is a cross-sectional view of a switch incorporating a support structure according to the present invention.

A switch 98 incorporating the support structure of the present invention is shown in FIGS. 4 and 5. Identical objects will be referred to with like reference numerals. Switch 98 is constructed of cup-shaped housing 28 and a base 100 which is similar to base 26 shown in FIG. 1. Housing 28 further has a central hole 102 and an eccentric hole 104. Circuit board 18 has an aperture 106 for accepting a lamp 108. Base 100 is formed with the a central inwardly longitudinally extending post 110 extending from a central portion of base 100 through a central hole 112 in circuit board 18, which has a plurality of fins 114 having a support surface for supporting the central portion of circuit board 18. Base 100 is further provided with a cylindrical annular indentation 116 for allowing access to a bottom surface of lamp 108 from the exterior of the assembled switch 98, thus allowing the lamp 108 to be replaced without opening the switch 98 and forcibly separating base 100 and housing 28, which might result in terminals 10, 12, 14 and 16 being forcibly broken off from circuit board 18 or in other damage to the elements of switch 98.

As shown in FIG. 5, circuit board 18 is imprinted with various circuitry 22, including a first and second continuous contact point 118 and 120, and three discrete contact points 122. Terminals 10 and 16 are connected with a first and second contact (not shown) formed on lamp 108, for illuminating lamp 108 at all times, regardless of the position of switch 98. Terminal 14 is connected to continuous contact points 118 and 120. Terminal 12 is connected to each of three discrete contact points 122 through three surface mounted devices 126 having preselected resistance and electrical characteristics. A selector 128 has three legs 130, 132 and 134 for contacting the contact points 118, 120 and 122, and making electrical connections therebetween. Selector 128 has three possible positions, and legs 130 and 132 contact continuous contact points 118 and 120 when selector 128 is in all three possible positions. However, leg 134 contacts each of discrete contact points 122 when selector 128 is in each of the three possible positions respectively.

Selector 128 is mounted to a central shaft 136, an inner end of which rotatably receives post 110 extending inward from base 100. A selector shaft 138 is rigidly mounted to an outer end of central shaft 136, and a selector knob 140 is non-rotatably affixed to selector shaft 138 by any known means, including a set screw 142 as shown in FIG. 4. A first spring 144 is provided to urge selector 128 into contact with contact points 118, 120 and 122. A canopy 146 is affixed to central shaft 136 and provides a seat for first spring 144. Canopy 146 further defines a cylindrical channel 148 for holding a follower ball 150 which is biased toward an inner wall of housing 28 by a second spring 156. Follower ball 150 is adapted to selectively contact three bumps (not shown) on inner surface of housing 28 for encouraging selector 128 to tend to be in only one of the three possible discrete positions, as opposed to an intermediate position therebetween. Switch 98 is affixed to, and selector shaft 138 extends through, a trim plate 152 having a transparent window 154 for allowing an operator to see the illumination provided by lamp 108.

The support structure of the present invention thus resists movement by terminals 10, 12, 14 and 16 relative to circuit board 18 in longitudinal and lateral directions, to resist damage of circuit board 18.

It should be understood that the preferred embodiment of the present invention has been shown and described herein, and that various modifications of the preferred embodiment will become apparent to those skilled in the art after a study of the specification, drawings, and following claims.

What is claimed is:

1. A support structure for resisting deformation of an electronic component comprising:

a longitudinally extending terminal affixed to said electronic component, said extending terminal being an electrically conductive terminal;

a carrier member including a pressing surface, said carrier member being a separate member from the extending terminal and being formed of an electrically nonconductive material, said terminal extending through said carrier member;

a base member positioned adjacent to the carrier member, said base member including a flexible tab extending therefrom, said flexible tab including a first stop surface engaging the pressing surface of said carrier member so as to secure said base member to said carrier member; and said carrier acting to resist a longitudinal force imposed on said terminal, thereby resisting deformation during connecting to said terminal.

2. The support structure as claimed in claim 1, wherein said carrier member and said base member further comprising a second pressing surface and a second stop surface respectively, whereby said first and second stop surfaces are adapted to resist an inward and outward longitudinal force respectively.

3. The support structure as claimed in claim 1, further comprising a lateral support member for resisting a lateral force imposed on said terminal, thereby resisting deformation by said lateral force of said electronic component.

4. The support structure as claimed in claim 1, wherein said carrier member further comprises a ramped projection defining said first pressing surface and a cam surface, said flexible tab defining a follower portion, said follower portion adapted to follow said cam surface and elastically deform said tab to allow said base member to be assembled into place, said first stop surface thereafter adapted to engage said first pressing surface.

5. The support structure as claimed in claim 1, wherein said pressing surface and said stop surface meet along a transverse plane, so that said pressing surface and said stop surface tend to remain engaged.

6. The support structure as claimed in claim 1, wherein said electronic component is a printed circuit board.

7. The support structure as claimed in claim 1, further comprising a second terminal affixed to said carrier member, said stop surface being adapted to resist a longitudinal force imposed on both of said terminals.

8. An electrical terminal support structure comprising:

a printed circuit board;

a longitudinally extending electrical terminal attached to said printed circuit board; and a carrier member substantially surrounding a longitudinally portion of said electrical terminal, said carrier member juxtapositioned at least partially against said printed circuit board, said carrier member including a projection defining a pressing surface and a cam surface, wherein said projection is configured to secure the carrier member to a base of the support structure, said carrier member acting to prevent forces applied to the terminal from being transmitted to the printed circuit board.

9. The support structure as claimed in claim 8, wherein said base includes a flexible tab defining a stop surface and a follower portion, said follower portion adapted to follow said cam surface and elastically deform said tab to allow said base to be assembled into place, said stop surface thereafter adapted to engage said pressing surface.

10. The support structure as claimed in claim 8, further comprising a second terminal affixed partially within said carrier member, said base including a stop surface, said stop surface being adapted to resist a longitudinal force imposed on both of said terminals.

11. The support structure as claimed in claim 8, further comprising a connector having locking members for engaging each other and resisting removal of said connector from said base.

12. The support structure as claimed in claim 8, wherein said electrical terminal has a blade-like configuration with a chamfered distal end insertable within a female mating terminal having contact members.

13. The support structure as claimed in claim 8, wherein said carrier member has a width with a dimension at least twice that of a thickness normal thereto, said carrier member further has an alignment pin extending therefrom for aligning with an alignment hole in said printed circuit board.

14. An electrical terminal support structure comprising:

a printed circuit board;

a longitudinally extending electrical terminal preattached to said printed circuit board, said extending terminal being an electrically conductive terminal;

a carrier member preattached to said electrical terminal, said carrier member being a separate member from the extending terminal and being formed of a nonconductive material, said carrier member including a projection; and a base having an opening therein through which said electrical terminal partially extends after preattachment of said electrical terminal to said printed circuit board and after preattachment of said carrier member to said electrical terminal, said base including a resilient tab member, said resilient tab member interlocking with the projection of the carrier member so as to secure the base to the carrier member.

15. The support structure as claimed in claim 14, wherein said projection is a ramped projection defining a pressing surface and a cam surface, said base further comprising a flexible tab defining a stop surface and a follower portion, said follower portion adapted to follow said cam surface and elastically deform said tab to allow said base to be assembled into place, said stop surface thereafter adapted to engage said pressing surface.

16. The support structure as claimed in claim 15, further comprising a second terminal affixed partially within said carrier member, said stop surface being adapted to resist a longitudinal force imposed on both of said terminals.

17. The support structure as claimed in claim 14, wherein said base and a connector further comprise locking members for engaging each other and resisting removal of said connector from said base.

18. The support structure as claimed in claim 14, wherein said electrical terminal has a blade-like configuration with a chamfered distal end insertable within a female mating terminal having contact members.

19. The support structure as claimed in claim 14, wherein said carrier member has a width with a dimension at least twice that of a thickness normal thereto, said carrier further has an alignment pin extending therefrom for aligning with an alignment hole in said printed circuit board.

20. An electrical terminal support structure comprising:

a printed circuit board;

at least a pair of terminals longitudinally extending from said printed circuit board;

a substantially nonconductive carrier member positioned between said at least a pair of terminals, said carrier member including at least one projection;

a base having openings therein through which said at least a pair of terminals partially extend, said base including an extending tab member; and said carrier member disposed between facing surfaces of said base and said printed circuit board and filling the majority of longitudinal space therebetween, wherein the projection of the carrier member interlocks with the tab member of the base to secure the base to the carrier member.

21. The support structure as claimed in claim 1, wherein the protection is a ramped projection defining a pressing surface and a cam surface, said base further comprising a flexible tab defining a stop surface and a follower portion, said follower portion adapted to follow said cam surface and elastically deform said tab to allow said base to be assembled into place, said stop surface thereafter adapted to engage said pressing surface.

22. The support structure as claimed in claim 20, further comprising a second terminal affixed partially within said carrier member, said stop surface being adapted to resist a longitudinal force imposed on both of said terminals.

23. The support structure as claimed in claim 20, wherein said base and a connector further comprise locking members for engaging each other and resisting removal of said connector from said base.

24. The support structure as claimed in claim 20, wherein said electrical terminal has a blade-like configuration with a chamfered distal end insertable within a female mating terminal having contact members.

25. The support structure as claimed in claim 20, wherein said carrier member has a width with a dimension at least twice that of a thickness normal thereto, said carrier member further has an alignment pin extending therefrom for aligning with an alignment hole in said printed circuit board.

* * * * *